United States Patent [19]

Judge et al.

[11] 4,230,091

[45] Oct. 28, 1980

[54] STOVE

[75] Inventors: Kenneth E. Judge, London; Jerald D. Hayter, Ilderton, both of Canada

[73] Assignee: Carmor Manufacturing Ltd., London, Canada

[21] Appl. No.: 936,067

[22] Filed: Aug. 23, 1978

[51] Int. Cl.[3] ..... F24C 1/00

[52] U.S. Cl. ..... 126/77; 126/60; 126/151; 126/200

[58] Field of Search ..... 126/62, 64, 66, 68, 126/77, 67, 98, 60, 61, 65, 76, 120, 144, 151, 200; 165/81

[56] References Cited

U.S. PATENT DOCUMENTS

| | | | |
|---|---|---|---|
| 169,317 | 10/1875 | Van | 126/98 |
| 758,237 | 4/1904 | Culter | 126/77 |
| 844,292 | 2/1907 | Thurston | 126/77 |
| 1,852,404 | 4/1932 | Elbert | 126/98 |
| 1,882,159 | 10/1932 | Nagle | 126/67 |
| 2,367,094 | 1/1945 | Blumstengel | 126/77 |
| 2,380,000 | 7/1945 | Walton et al. | 126/77 |
| 2,420,135 | 5/1947 | Hennig | 165/81 |
| 2,969,787 | 1/1961 | Dupler | 126/200 |
| 3,237,622 | 3/1966 | Best | 126/77 |
| 3,420,020 | 1/1969 | Keppelman | 126/120 |
| 3,880,139 | 4/1975 | Young | 126/62 |
| 4,027,649 | 6/1977 | Jackson | 126/62 |
| 4,051,831 | 10/1977 | Schellens | 126/217 |
| 4,060,068 | 11/1977 | Lever et al. | 126/120 |

*Primary Examiner*—Carroll B. Dority, Jr.
*Assistant Examiner*—Lee F. Barrett
*Attorney, Agent, or Firm*—Shoemaker and Mattare, Ltd.

[57] ABSTRACT

A stove having walls which are shaped and supported to prevent warping thereof. A combustion chamber in the stove is defined by bottom and side walls positioned and oriented to maximize the space available for such a chamber. The walls of the combustion chamber have top caps thereon for ensuring and maintaining the proper positioning of those walls. Further holding elements are included in the stove to maintain the combustion chamber walls in position. An alternative embodiment of the stove includes front opening access doors.

12 Claims, 15 Drawing Figures

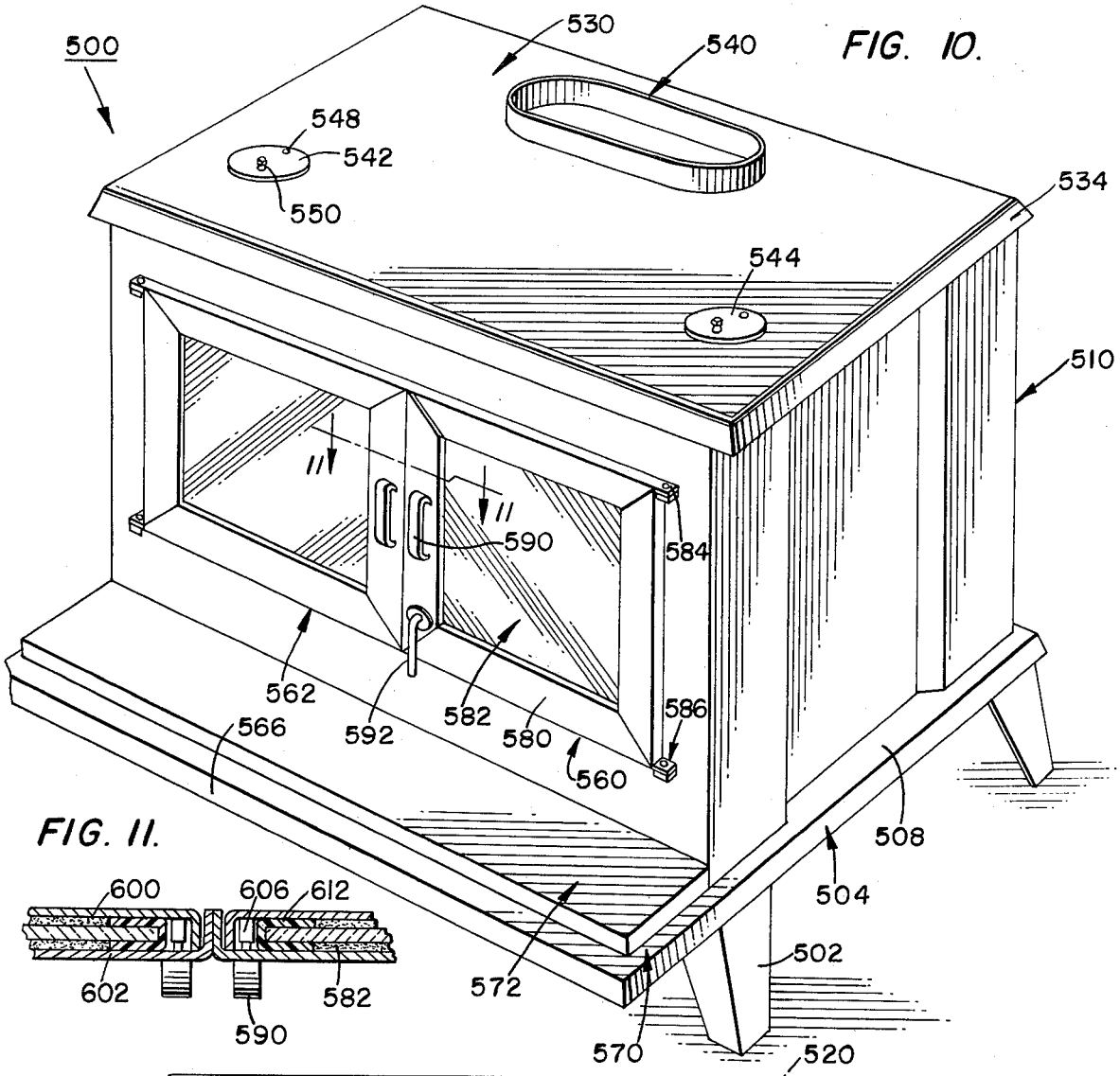
FIG. 10.
FIG. 11.
FIG. 12.
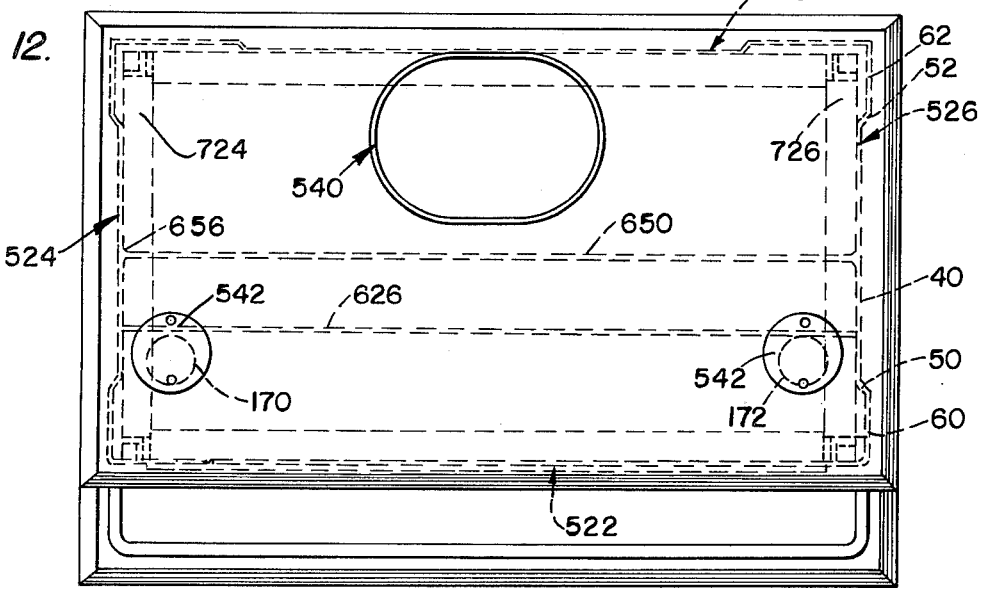

STOVE

BACKGROUND OF THE INVENTION

The present invention relates in general to stoves, and, more particularly, to wood burning stoves.

The wood burning stove has been in use for many years as a means for providing heat as well as a means for cooking, and the like. An early example of such a stove is the Franklin stove.

Recently, interest in wood burning stoves has increased, and such stoves are enjoying increasing popularity in homes, cabins, camps, cottages, or the like. As a result of this increased interest, wood burning stoves have improved over the Franklin stoves, and other such stoves.

Examples of such improvements can be found in stove burning efficiency, improvements in access to the stove, increases in the ease with which fuel is inserted into the stove, and the ease with which ash can be removed from the stove, improvements in stove aesthetic appearances, improvements in stove versatility, and so forth.

A stove incorporating many improvements is disclosed in U.S. Pat. No. 4,051,831, issued to E. P. Schellens, on Oct. 4, 1977. The Schellens stove is disclosed as being air-tight and thus is designed to control the amount of air available for the combustion process. The Schellens stove operates at subatmospheric pressure, which produces efficient fuel combustion and ash accumulation which is reduced from other stoves.

While representing an improvement over may other stoves, the Schellens stove still has several deficiencies. For example, even though measures are taken to prevent warping, the stove body disclosed by Schellens is still subject to warping during heating and cooling cycles, thereby raising the possibility that the air-tight nature of the stove may be vitiated. The Schellens stove has a firebox containing a U-shaped hearth plate and firebox liners arranged in a V-shaped configuration to have inwardly declining walls. Such a design makes manufacture and shipping difficult and expensive. It is also noted that the capacity of the stove is reduced by the V-shaped firebox inner volume in the Schellens device.

The walls of the Schellens stove are not supported in the vertical direction, and due to the temperature gradients developed during heating and cooling cycles of the stove, vertical warping of the stove walls is possible.

Accordingly, there is need for a stove which is easily manufactured and shipped, secure against warping, and easy to use while still making maximum use of the capacity thereof.

SUMMARY OF THE INVENTION

The stove embodying the teachings of the present invention is easily manufactured, shipped and used. The stove is air-tight and the walls thereof are supported against warping.

The stove of the present disclosure includes vertical walls having a central portion which is recessed from the end portions thereof and further includes an anti-warping bar on at least one of the walls of the stove. In a preferred embodiment, anti-warping bars are positioned on the front and rear walls of the stove and extend vertically on those walls. A combustion chamber is defined in the bottom of the stove by refractory material positioned on the bottom of the stove, and next to the walls of that stove. Holder supports are located in the corners of the stove to maintain the refractory material in place.

A flue thimble or flue collar is located above the combustion chamber to provide a path out of the stove for products of combustion, and draft tubes depend into the stove from a stove top wall for inducting controlled amounts of air into the stove.

The refractory material walls have top caps located thereon. The top caps are simply placed on top of the walls and are not attached either to the refractory walls or to the stove walls.

Another embodiment of the stove includes front opening doors and an anti-warping bar on the top wall of the stove as well as a baffle plate located inside the stove. The top caps in this embodiment are a part of the walls, but still are not attached to the refractory walls.

The anti-warping bars are attached to the stove walls and prevent thermally induced stresses from causing the stove walls to warp. Such warping could vitiate the air-tight nature of the stove as well as the aesthetic appearance thereof. The corner located holder supports further enhance the anti-warping advantages of the presently disclosed stove.

The refractory material of the presently disclosed stove is located within the stove to be easily located and maintained in position. Furthermore, that material is positioned to define a combustion chamber which is rectangular in both vertical and horizontal cross-section, thereby matching the corresponding cross-sections of the stove. Such refractory material configuration makes the most efficient use of the space within the stove, and thus stove efficiency is increased over known stoves.

The doors in the alternative embodiment provide a convenient access means for the stove, while retaining the air-tight nature of the stove. The air-tight nature of all embodiments of the stove of the present disclosure ensure controlled, balanced burning and heat output. Warping is prevented by the anti-warping bar in the stove, and the refractory material is oriented and positioned as in the first-mentioned embodiment. Top caps are used in this embodiment also to ensure the proper and continued orientation of the refractory material.

OBJECTS OF THE INVENTION

It is, therefore, a main object of the present invention to provide a stove with improved anti-warping features.

It is another object of the present invention to provide a stove into which refractory material is easily positioned and maintained in position.

It is yet another object of the present invention to provide a stove which makes efficient use of the space within that stove.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIG. 10 is a perspective of another embodiment of the stove embodying the teachings of the present invention.

FIG. 11 is a view along line 11—11 of FIG. 10.

FIG. 12 is a plan view of the stove shown in FIG. 10.

DETAILED DESCRIPTION OF THE INVENTION

Figure 1:
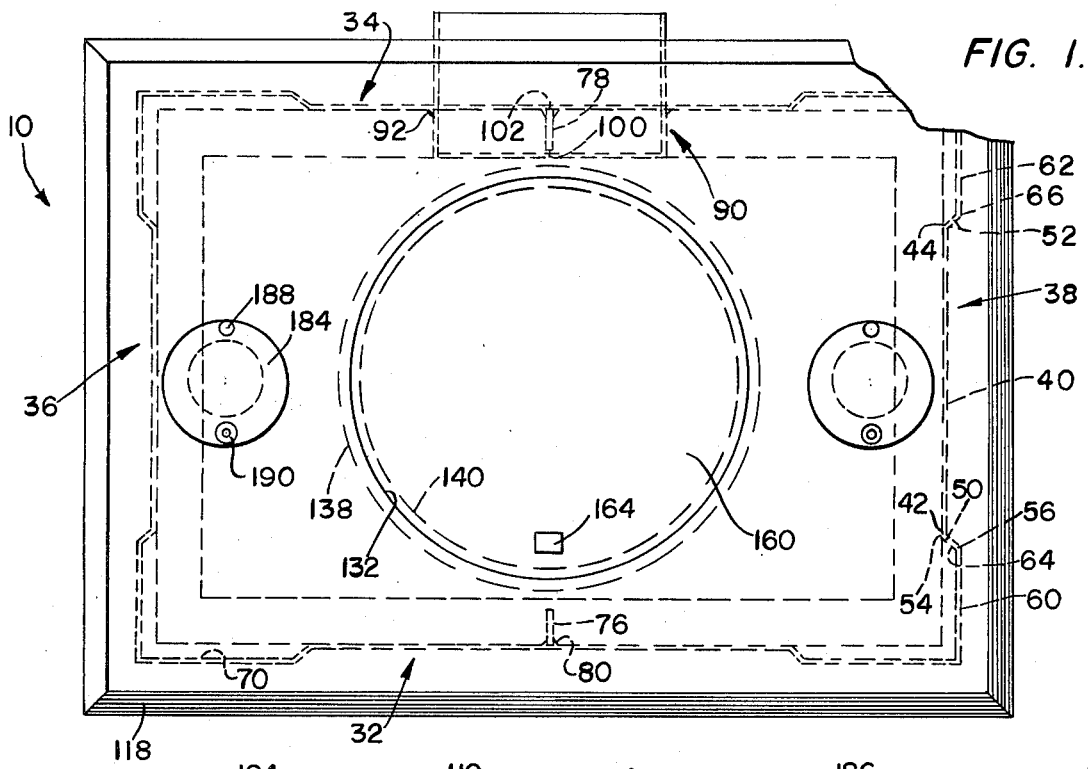
FIG. 1 is a plan view of a stove embodying the teachings of the present invention.
Figure 2:
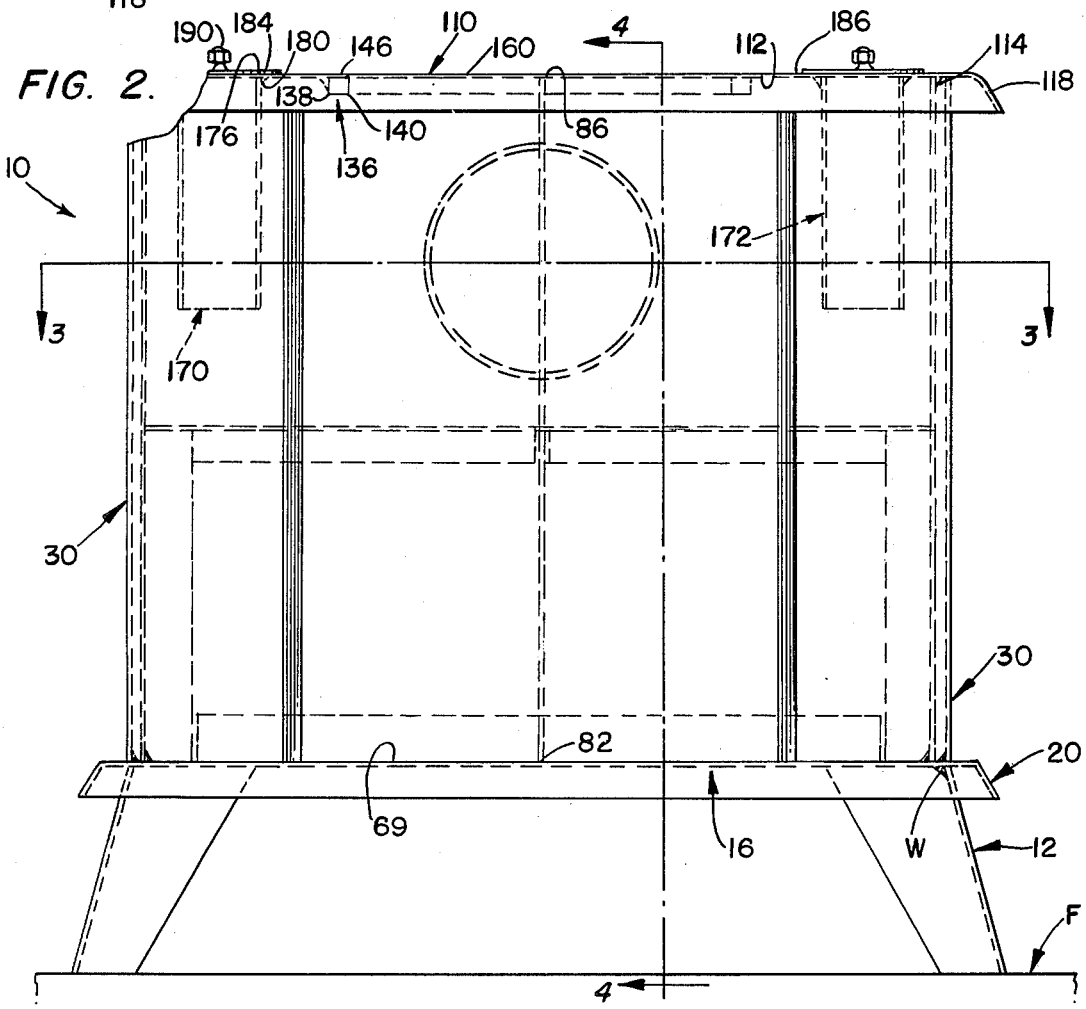
FIG. 2 is an elevation view of the stove shown in FIG. 1.

Shown in FIGS. 1 and 2 is a stove 10 embodying the teachings of the present invention. Stove 10 includes a plurality of support legs 12 resting on a floor F or other such support. The legs permit the stove to be installed in areas which do not have fireplaces or other such structures. The legs 12 are attached to and outwardly depend from a bottom chassis 16 having a skirt 20 flaring outwardly and downwardly therefrom. The legs and skirt are attached to the chassis as by welding or the like, as indicated at W in FIG. 2. An outer body 30 extends upwardly from the chassis and includes a front wall 32, a rear wall 34 and a pair of side walls 36 and 38. Each wall is unitary and includes an elongate central portion 40 having upright side edges 42 and 44. Integral with the central portions are offset portions 50 and 52 which are outwardly and forwardly angled with respect to the central portions and include upright side edges 54 and 56, with side edges 54 being integrally connected to the side edges 42 and 44 of the central portion. Each wall further includes a pair of upright, elongate end portions 60 and 62 each being offset from the central portion to be in spaced parallelism with that central portion and each having a pair of upright side edges 64 and 66 with edges 64 being integrally connected to the edges 56 of the offset portions 50 and 52.

Figure 4:
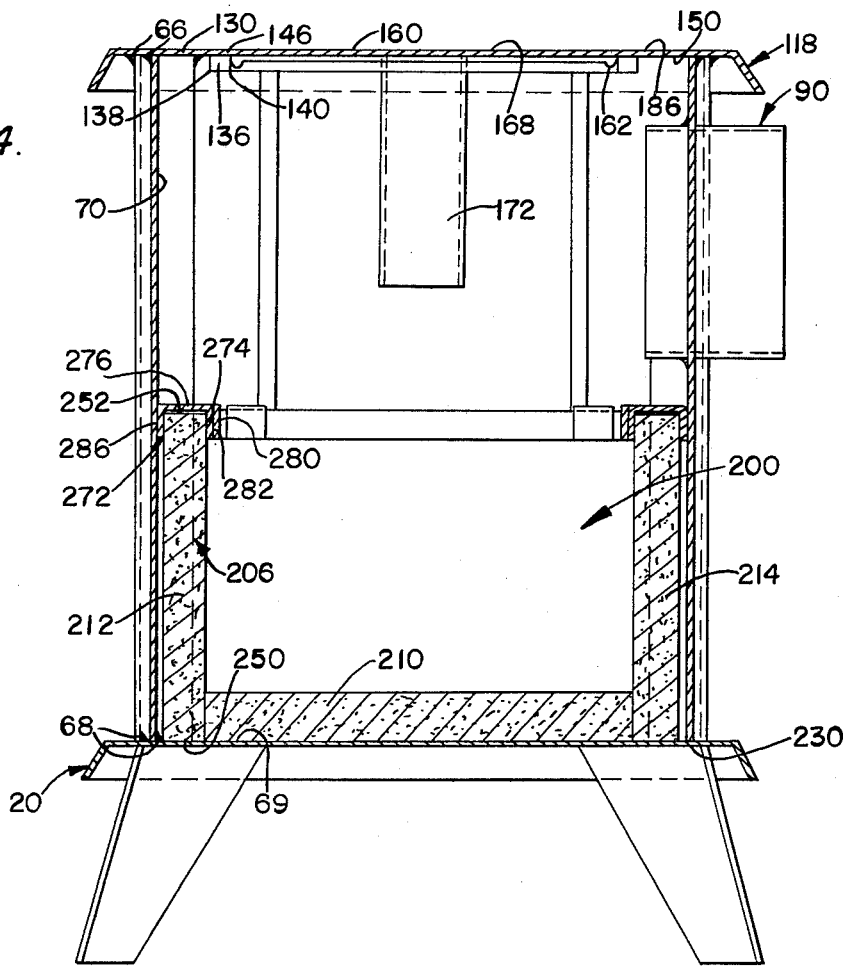
FIG. 4 is an end elevation of the stove embodying the teachings of the present invention.

As seen in FIGS. 1 and 4, each wall includes a top edge 66 and a bottom edge 68. The bottom and top edges are all coplanar with each other and the bottom edges are attached to the upper surface 69 of the bottom 16. Thus, the walls include a pair of outer portions and a central indented portion. Such configuration serves to stiffen the stove and thereby to prevent warping thereof during the heating and cooling cycles undergone by that stove.

Each wall has an inside surface 70, and, as shown in FIG. 1, a front anti-warping bar or front stiffener 76 is attached to the front wall, and a rear anti-warping bar, or rear stiffener 78 is attached to the rear wall. The stiffeners are upright with a lower end 82 (FIG. 2) located on or closely adjacent inner surface 69 of the stove bottom 16. The front and rear stiffeners are located essentially medially of the walls, and each has a top end 86 and 87, respectively. The stiffeners are attached to the wall inner surfaces by welds 80, or other such means to be attached to the wall securely enough to function as an anti-warping element which prevents the wall from deforming during the heating and cooling cycles of the stove.

The recessed configuration of the walls of the stove embodying the teaching of the present disclosure, coupled with the stiffeners, enables this stove to provide significantly more heat output for a given weight of stove then other stoves. The stove can be manufactured of materials which have good heat transfer properties. The ribbed design of the walls further increases the area available for heat transfer again increasing the efficiency of the stove. A preferred wall material is $\frac{1}{8}$ inch mild steel plate.

A tubular flue thimble 90 is attached to the rear wall as by welds 92, or the like, and extends therethrough near the longitudinal centerline of that wall. Therefore, as seen in FIG. 1, the rear stiffener is aligned with a diameter of the thimble 90. To accommodate the flue thimble, the rear stiffener extends upwardly only for a portion of the height of the rear wall so that the top end 87 of that rear stiffener is located beneath the flue thimble. The top end 86 of the front stiffener is located at or near the top edge of the front wall. As shown in the Figures, the stiffeners are elongate rectangles in shape with the ends thereof vertically spaced and the sides 100 and 102 thereof horizontally spaced. The stiffeners are transversely perpendicular to the inner surface 70 of the wall to which they are attached and thus extend inwardly of the stove orthogonally with respect to the walls. The front and rear stiffeners are coplanar with each other in the FIG. 1 embodiment. The orientation and location of the stiffeners on the walls thus permits those stiffeners to resist the warping forces exerted on the wall in a most effective manner. It is also noted that the stiffeners can be located at other positions if desirable. The stiffeners, in conjunction with the recessed shape of the walls, thus prevent warping of the stove walls during the heating and cooling cycles of the stove.

As best shown in FIG. 2, the stove includes a top 110 having an undersurface 112 attached to the top edges 66 of the walls, as by welds 114, or the like. Welds 114, like all the other welds and connections of the presently disclosed stoves, are effected in a manner to produce an air-tight structure. The top 110 is rectangular in shape and has a skirt 118 outwardly and downwardly flaring from the outer periphery thereof. The top skirt is identical to the bottom skirt, and the top and bottom of the stove are both the same size as well. As best shown in FIGS. 1 and 4, the top 110 includes a planar portion 130 with a centrally located opening 132 defined therethrough. The opening is an access means for loading fuel, such as wood or the like, into the stove and/or for removing ash therefrom. A ring 136 surrounds the access opening and has an outer side edge 138 located outside of the opening and an inner side edge 140 located inside the opening. The ring has an upper surface 146 and is attached to undersurface 112 of the stove top by welds or the like. The top surface of the ring thus forms a support for a lid 160 which fits into the access opening to close same when desired. As shown in FIG. 4, the lid can have an annular protrusion 162 circumferentially positioned thereon to abut the ring 136 to thereby hold the lid in place in a secure and tight manner. The lid is removable and serves those purposes usual to such lids, such as a heating element for cooking and other such functions as will occur to those skilled in the art. A lift catch 164 is positioned on lid upper surface 168 to which a lifting element, such as a handle, or the like, is attached for moving the lid.

As best shown in FIG. 2, a pair of draft tubes 170 and 172 are located within the stove and depend vertically downwardly into the interior of the stove. The tubes have the upper rims 176 thereof attached to the top undersurface by welds 180 or the like, and are suspended therefrom. A pair of draft tube cover discs 184 are each pivotally mounted on top upper surface 186 by a pivot pin 188 and each has a handle 190 thereon. The cover discs serve the purpose of covering and uncovering the vent tubes to control the amount of ventilation provided to the stove. The draft tubes deliver air which has been pre-warmed directly to the stove combustion chamber. Such a delivery creates a "blowtorch" effect and produces intense and nearly complete burning and secondary burning of combustible products and gases. The downdraft system also eliminates the need of a grate.

Figure 3:
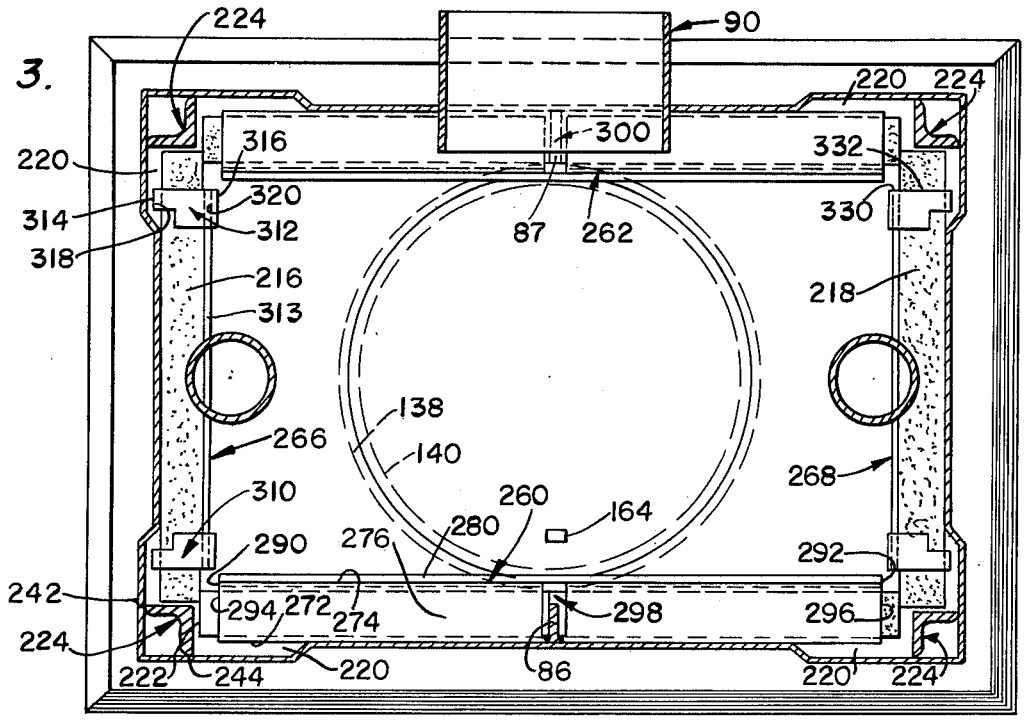
FIG. 3 is a view along line 3—3 of FIG. 2.

As best shown in FIGS. 3 and 4, the stove contains a combustion chamber 200 near the bottom thereof. The combustion chamber is bounded by refractory material 206, such as firebrick, or the like. The walls are removably mounted in the stove. Thus, a chamber bottom 210 is formed by the refractory material resting on the stove bottom, chamber front and rear walls 212 and 214, respectively, are formed by the refractory material located adjacent the stove front and rear walls, respectively, and chamber sides 216 and 218 are formed by the refractory material located adjacent the stove sides. The refractory material is of suitable thickness and has the outside surfaces thereof in contact with or closely adjacent the inside surface of the recessed central portions of the walls as shown in FIG. 3. The firebrick of the stoves of the present disclosure thus lines the walls of the combustion chamber and therefore helps to eliminate warping and burn-outs while holding heat. There are thus voids 220 defined between the refractory material and the inner surfaces of the stove walls adjacent the end portions of the stove walls. As best shown in FIG. 3, the refractory chamber defining walls have ends 222 which are at right angles with each other and in overlapping relationship with each other.

A plurality of angle elements form corner braces or holder supports 224 for holding the refractory material in position in the stove. The holder supports are located in the voids 220 with the back surfaces thereof presented toward the adjacent chamber wall defining ends 222. As shown in FIG. 4, the supports 224 are upright in orientation and have the lower ends 230 thereof resting on and welded to the inner surface of the stove bottom to be attached thereto by welds, or the like. The top ends of the supports are located near the top edges of the refractory material walls.

Outside edges 242 and 244 of the holders are positioned to contact the stove walls and may provide additional warp preventing features to the stove. The combustion chamber 200 is of an appropriate height and the walls thereof have bottom edges 250 resting on the stove bottom and top edges 252 spaced upwardly therefrom. The enclosure defined by the walls is thus essentially rectangular in both vertical and horizontal cross-section to maximize the volume within the stove used as a combustion chamber.

The walls are self-supporting, but have top caps thereon. The front and rear walls have front and rear top caps 260 and 262, respectively, and the side walls have side top caps 266 and 268 thereon. The front and rear top caps have channel-shaped sections which include a pair of depending legs 272 and 274 attached to a web section 276 to be in spaced parallelism with each other. The channel legs are spaced to snugly receive the refractory material therebetween as shown in FIG. 4. A cap reinforcing element 280 is attached to outside surface 282 of leg 274, and the outside surface 286 of leg 272 contacts, but is not attached to, the inside surface of the corresponding wall recess. The reinforcing elements are rectangular, and, as shown in FIG. 3, extend the full length of the corresponding top cap so that ends 290 and 292 of the reinforcing element are coplanar with ends 294 and 296, respectively, of the associated top cap. The front and rear top caps have cut out portions 298 and 300, respectively, defined therein to accommodate the front and rear stiffeners, respectively. The front and rear top caps can be formed from a single unitary sheet of material by folding the edges thereof to define the legs of the channel, and by cutting out appropriate areas of the material to define the stiffener accommodating openings. It is here noted that the stiffeners are not attached to any of the fabric holders in any way.

The side top caps each includes a pair of U-shaped channel members, such as members 310 and 312, on top cap 266 connected by a metal strap such as strap 313. The members 310 and 312 each has a pair of spaced parallel legs 314 and 316 which have inside surfaces 318 and 320, respectively. The inside surface 318 contacts the refractory material and the strap 313 is attached, as by welding, to the inside surface 320 as shown in FIG. 3. The side top caps and the elements thereof are sized to receive the side chamber defining walls without interfering with the front and rear top caps or the stove walls. Thus, the members 310 and 312 are located to have one leg thereof in the voids 220, and the strap has ends 330 which are coplanar with ends 332 of the channel members.

The top caps are simply dropped onto the top of the refractory material walls and are not otherwise attached thereto.

Figure 7:
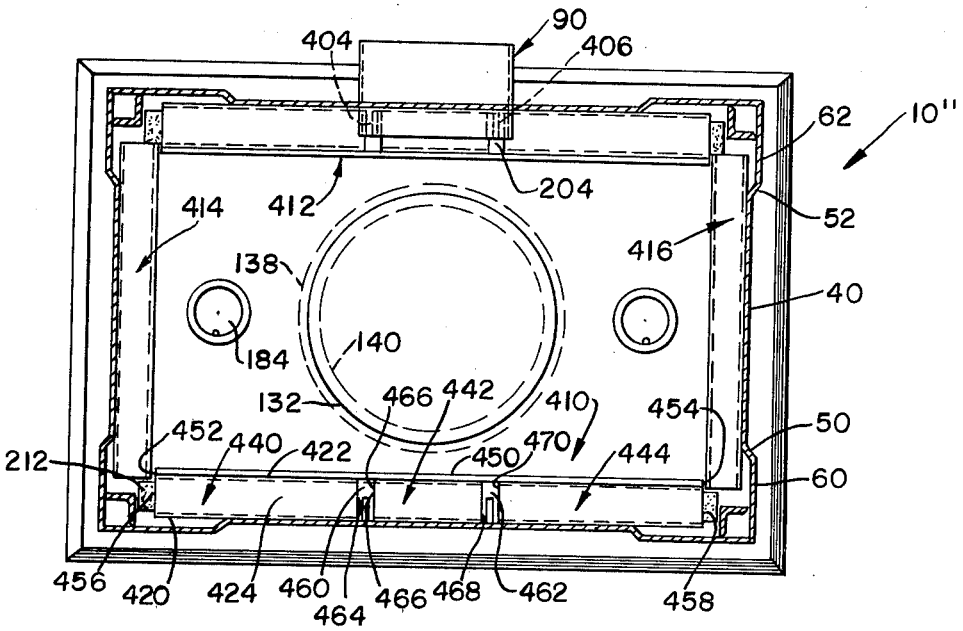
FIG. 7 is a plan view of another embodiment of the stove embodying the teachings of the present invention.
Figure 8:
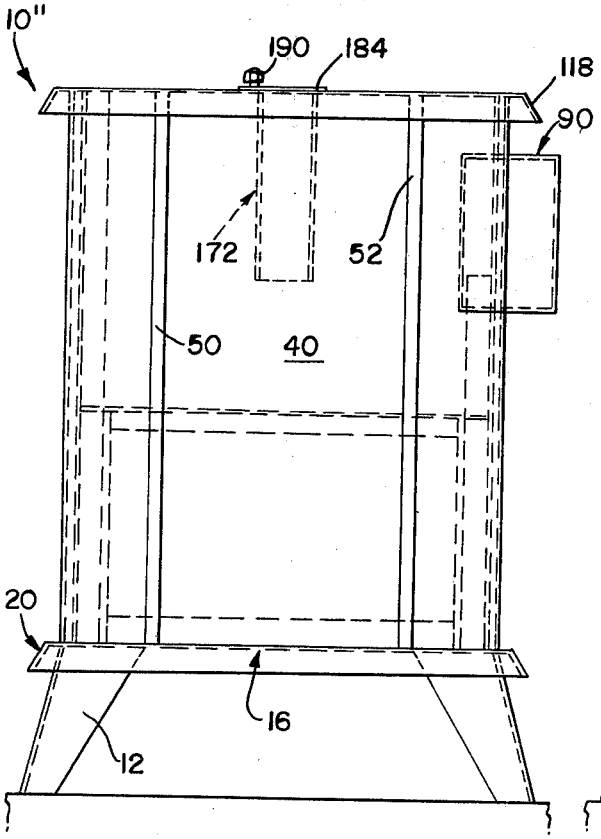
FIG. 8 is an end elevation view of the stove shown in FIG. 7.
Figure 9:
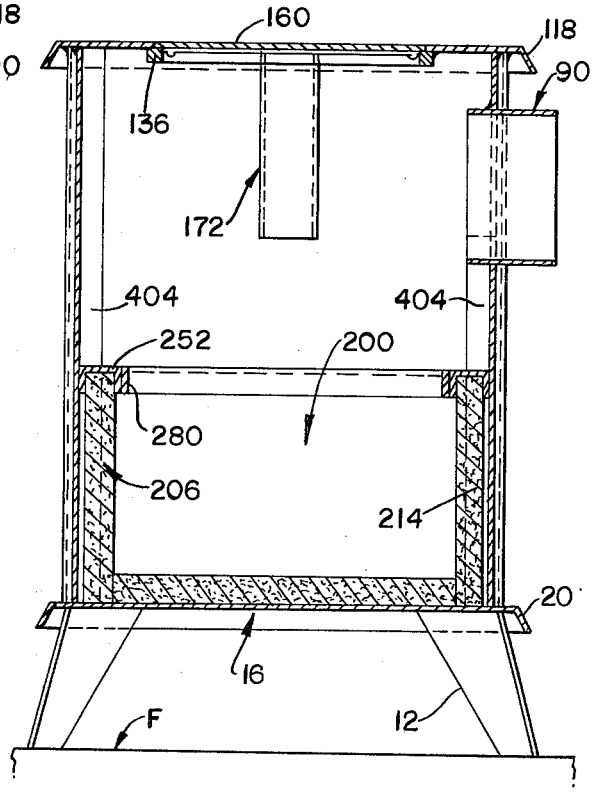
FIG. 9 is a view along line 9—9 of FIG. 6.
Figure 13:
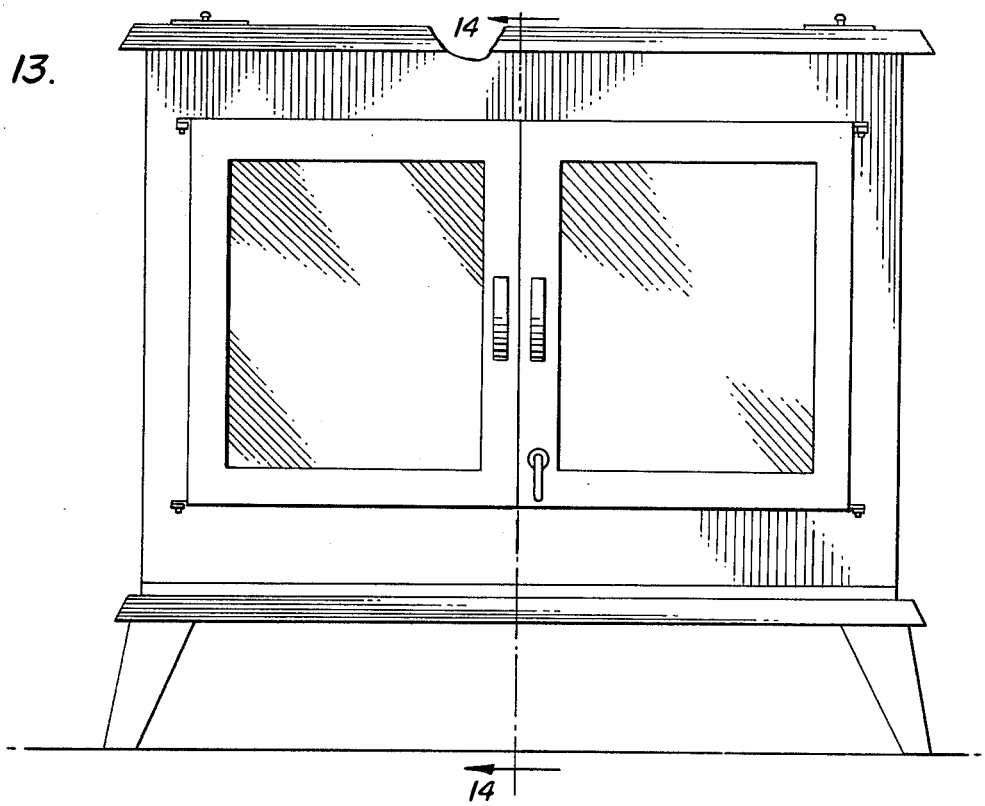
FIG. 13 is a front elevation of the stove shown in FIG. 10.

Modifications of the stove are shown in FIGS. 5–9, and the stove is denoted by the indicators 10' and 10''. The stoves 10' and 10'' each includes pairs of front and rear anti-warping bars or stiffeners 404 and 406, respectively. The stiffeners of each pair are in spaced parallelism with each other, and are co-planar with corresponding ones of the stiffeners in the other pair as shown in FIG. 7. As in stove 10, the rear stiffeners are shorter than the front stiffeners to accommodate the flue thimble. As shown in FIG. 7, the stove 10'' includes a front top cap 410 resting on the front chamber wall top, rear top cap 412 resting on the rear chamber wall top, and side top caps 414 and 416 resting on the side chamber wall tops. The top caps of stove 10'' all include channel-shaped sections each having a front leg such as leg 420, and a rear leg such as leg 422 interconnected by a web such as web 424. The channel sections of the top caps of the stoves 10' and 10'' are all sized to snugly receive the refractory walls between the legs thereof. As shown in FIG. 7, the front and rear top caps of stove 10'' include a plurality of sections, such as sections 440, 442 and 444, which are each channel-shaped and which are interconnected by an elongate strap 450 attached at one face thereof to the outer face of the inner legs of the top cap sections. The reinforcing strap 450 is rectangular and has ends 452 and 454 thereof coplanar with outer ends 456 and 458 of the top cap sections 440 and 444, respectively. The top cap sections 440 and 444 are preferably of equal lengths and are longer than the top cap middle section 442. The sections are spaced from each other as shown in FIG. 7 to define stiffener receiving spaces, such as spaces 460 and 462 located between opposing ends 464, 466 and 468, 470 of the top cap sections 440, 442 and 444.

As is also shown in FIG. 7, the side top caps of stove 10'' are one-piece channels and do not have any additional reinforcing elements similar to the strap 450.

Figure 5:
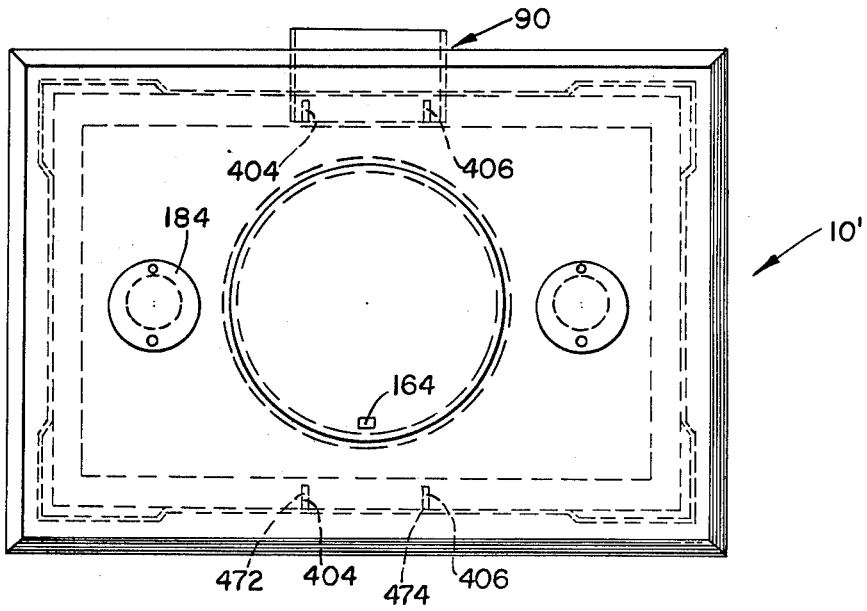
FIG. 5 is a plan view of another form of the stove embodying the teachings of the present invention.
Figure 6:
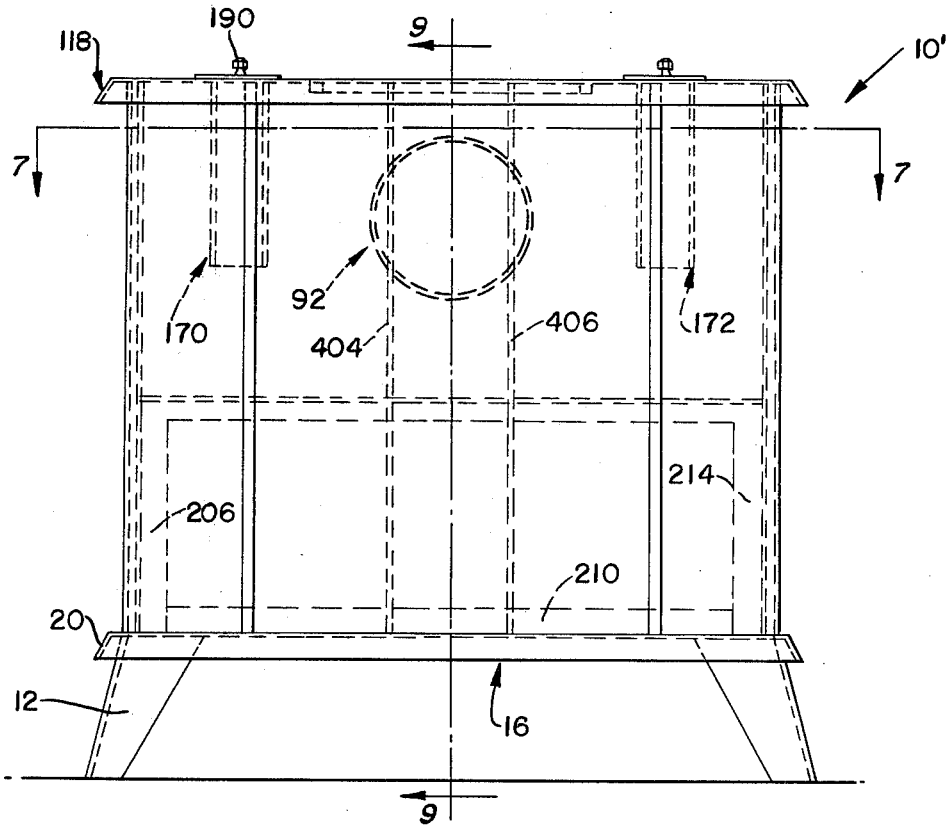
FIG. 6 is an elevation view of the stove shown in FIG. 5.

The top caps in the stove 10', as shown in FIG. 5, are all unitary with the front and rear top caps each having cutout portions 472 and 474 defined therein to receive the stiffeners. As in the FIG. 7 embodiment, the side top caps are unitary in the stove shown in FIG. 5.

As in stove 10, the top caps in stoves 10' and 10'' are not attached to the refractory material walls, but simply are dropped onto those walls.

Still another embodiment of the stove embodying the teachings of the present invention is shown in FIGS. 10–15 and is indicated by the numeral 500. The stove 500 includes a plurality of legs 502 depending from a bottom 504 which includes an upper surface 508. The stove includes a frame 510 having a rear wall 520, a front wall 522 and side walls 524 and 526. The rear wall and the side walls are shaped in a manner similar to those walls in stoves 10, 10' and 10'', that is, a central portion is located between a pair of offset portions which are connected to end portions which are coplanar with each other and are in spaced parallelism with the central portion recessed therebetween. The walls rest on the bottom upper surface 508, and extend vertically upward therefrom to terminate in coplanar upper edges on which rests stove top 530. The stove top 530 includes a planar central element having a skirt 534 flaring outwardly and downwardly from the peripheral edge thereof. An oblong flue collar 540 is positioned in the stove top as are draft tube control covers 542 and 544. The draft tube control covers include discs pivotally attached to the stove top by pivot pins 548, and have handles 550 thereon, as in stoves 10, 10' and 10''.

The stove 500 includes a pair of access doors 560 and 562 hingeably mounted on the front wall thereof as shown in FIG. 10. The front wall is backset from front edge 566 of the stove bottom to define an apron 570 in front of the access doors. An element 572 such as an ash bar can be placed on the apron for receiving logs, or other material. The element 572 may be attached to the apron as by welding, or the like.

Each door includes a frame 580 surrounding a viewing area which may be covered by a viewing element, such as heat resistant glass 582, or the like. Hinges 584 and 586 attach each of the doors to the outside surface of the front wall to enable those doors to swing outwardly away from the front wall to expose an access opening in the stove front wall through which material, such as logs, or other combustible material, or ashes, or the like can be moved into and/or out of the stove.

Each door has a handle 590 and a latch handle 592 is located on one of the doors. The latch handle is used to operate a device for locking the doors closed over the access opening and can include elements usual to such devices. Thus, a hook element, or a jam element, or the like can be included to lock the doors together and to the stove front wall in a snug, secure and air-tight manner.

The door frames are best shown in FIG. 11 and include an inner U-shaped element 600 and an outer U-shaped element 602 with edges of the inner element abuttingly held against the inner surface of the outer element. A bolt 606 is used to hold the handle on the door frame. The frames can include edge members which maintain the inner and outer elements together, and to which the hinges can be attached. The heat resistant see-through element, such as the glass 582, is interposed between the two frame elements, as shown in FIG. 11. A gasket 612 is located about an edge of the glass to circumferentially surround that glass and provide, and maintain, a tight, secure seal between the access door viewing area covering and the frame elements 600 and 602. In this manner, the air-tight nature of the stove is maintained. As in the stoves 10, 10' and 10'', the air-tight nature of the stove provides steady, predictable burning rates of the fuel, as the amount of air inducted into the stove can be carefully controlled by the draft tube controls, without any problems which would otherwise attend leaks. Of course, the stoves are sealed at any joints to assure this air-tight feature.

Figure 14:
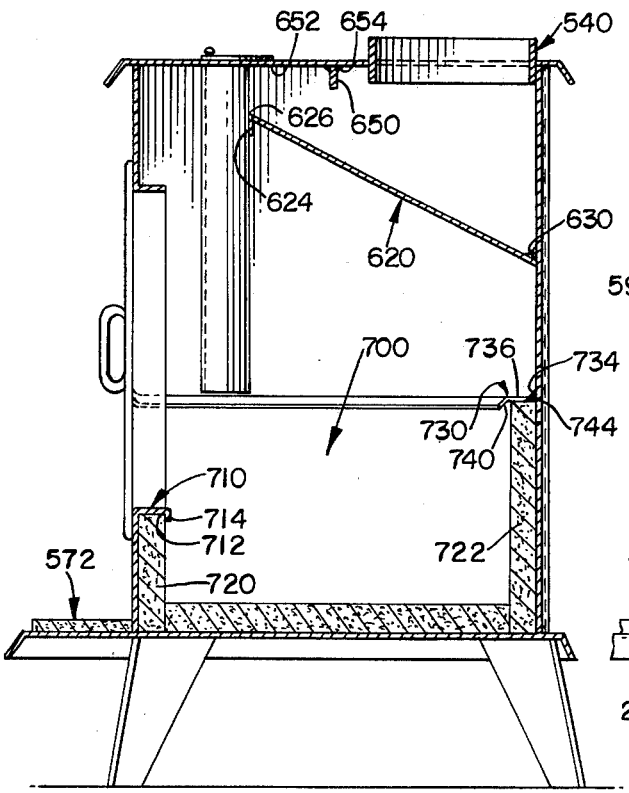
FIG. 14 is a view along line 14—14 of FIG. 13.
Figure 15:
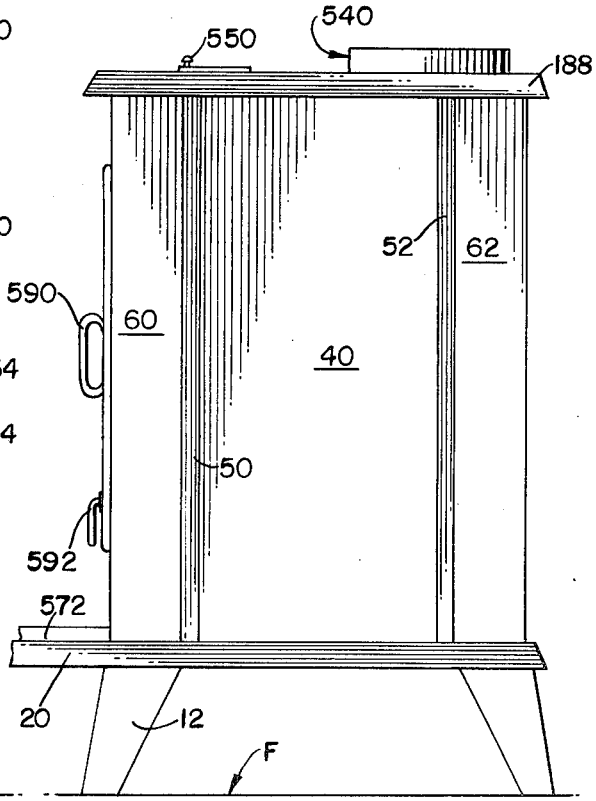
FIG. 15 is an end elevation of the stove shown in FIG. 10.

In the preferred embodiment of stove 500, each door is made of steel, and the outer frame is brass plated and covered by a high temperature lacquer. As best shown in FIG. 14, the door frame fits flushly with the body of the stove to ensure the air-tightness of the stove. The handles 590 are preferably solid brass. The glass 582 will withstand high temperatures and is held in place between the frame elements in the preferred embodiment of stove 500 by a ¾ inch strip of K-Wool which is an asbestos-type substance and Vycor high temperature glass, developed by Corning Glass Works, or the like. Preferred dimensions of the stove 500 include 24''×24''×17'' and 28''×28''×20'' overall; other stoves can have dimensions of 29''×33''×23''.

An internal baffle plate 620 is best shown in FIG. 14 and is planar having a hook 624 on one edge 626 thereof which is located to be closely adjacent the draft tubes of the stove 500, as best shown in FIG. 12. The plate is connected to the inner surfaces of the stove rear and side walls by welds, such as weld 630, or the like, and is rearwardly slanted within the stove. Hot gases as well as smoke and other products of combustion developed within the stove combustion chamber flow around the baffle plate and upwardly into a stove flue via the flue collar. The baffle plate forces hot gases to the front of the stove where a secondary burning action occurs.

An internal stiffener 650 is attached to undersurface 652 of the stove top by weld 654 or the like. The stiffener 650 is elongate and extends from one side of the stove to the other, and, as shown in FIG. 12, is attached to the stove sides at the edges thereof by welds, such as weld 656, or the like. The stiffener 650 is rectangular and has the width dimension thereof oriented perpendicularly of the stove top undersurface and is attached thereto along one side edge thereof. The other side edge of the stiffener is presented downwardly to the stove. The stiffener is preferably located medially of the front and back walls of the stove, but can be located elsewhere to prevent warping of the stove top. Futhermore, additional stiffeners can be located on the stove top in various locations if desired.

The stiffener works in conjunction with the recessed shape of the stove walls to prevent warping of the stove during the heating and cooling cycles thereof.

A combustion chamber 700 of the stove 500 is best shown in FIG. 14. As shown in FIG. 14, the access opening is surrounded by an internal flange 710 which has a lower element 712 which includes a hook 714 thereon. As shown in FIG. 14, the combustion chamber is surrounded by refractory material which forms a front wall 720, a rear wall 722 and side walls 724 and 726 (see FIG. 12). All of the walls rest on the stove bottom, and the front wall is shorter that the other walls which have the top edges thereof colevel and coplanar with each other to be the same height. The front wall is top encased by the flange 710 which acts as a top cap therefor, and a top cap 730 is attached to the inner surfaces of the rear and side walls as by a weld 734, or the like. The top cap 730 includes a planar portion 736 and a depending lip portion 740. The top cap 730 contacts, but is not attached to, the top surface 744 of the top edges of the combustion chamber rear and side walls. The top cap and the flange 710 serve the same function as the top caps in stoves 10, 10' and 10'', and thus keep the refractory material in proper position within the stove to define the combustion chamber 700 of the stove 500.

As in the stoves 10, 10' and 10'', the stove 500 can include angle elements in the corners thereof to ensure that the refractory material maintains the desired position within the stove.

As shown in FIG. 12, the draft tubes are spaced inwardly of the stove side walls a distance sufficient to provide an adequate clearance between those tubes and the top caps.

The operation of the stoves 10, 10', 10'' and 500 is evident from the foregoing and will therefore be described only in a brief manner. Combustible material is inserted into the stove via the access opening and located in the combustion chamber, or firebox. The material is ignited in a usual manner, and the access opening of the stove is then closed. The draft tube cover discs are adjusted so the proper amount of air is inducted into the combustion chamber via the draft tubes, and due to the air-tight nature of the stoves, the only air introduced into the stove is via the draft tubes and thus, the amount of air can be closely controlled to produce the most efficient combustion. The air impinges directly onto the fire from above, and the draft is developed in the usual manner to assure continued air induction into the stove. Products of combustion flow out of the stove via the flue thimble which is located above the combustion chamber, and into a flue for proper disposal, and the heat generated by the fire is transferred into a room by the stove. The air-tight nature of the stove enables the stove to operate at combustion chamber pressures amenable to efficient combustion. It is noted that the stove top provides a large cooking area having a plurality of different temperature areas. The front loading stove 500 can accept logs as long as 26", and the other, top loading stoves have openings on the order of 11".

The air-tight warping features provided by the stiffeners and wall configuration of the stove prevents warping of the stove during the heat-up and cool-down cycles thereof, and thus reduces the possibility of leaks developing, or other such problems associated with warping.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A stove comprising:

a base;

a stove front, rear and side walls on said base and extending away therefrom, said rear and side walls each including a central portion, an end portion on each end of said central portion, and offset portions connecting said central and end portions together, said end portions being essentially coplanar with each other and in a plane which is in spaced parallelism with a plane containing said central portion;

a stove top wall on said walls and spaced from said base;

at least one anti-warping bar on each of said front and rear stove walls, said anti-warping bars each extending upward from adjacent said base for essentially the entire length of said front and rear stove walls, said anti-warping bars and said wall portions providing structural support for a stove while increasing the heat output of that stove;

a firebrick combustion chamber located within the stove and including a bottom on said base, and combustion chamber walls located inwardly adjacent said stove front, rear and side walls and extending from said base for a portion of the distance between said base and said top wall, those combustion chamber walls located adjacent said front and rear stove walls each having a channel defined therein for accommodating said anti-warping bars;

holder support means located adjacent the intersection of said combustion chamber walls for positioning said combustion chamber walls and for reinforcing said combustion chamber wall intersections; and channel-shaped top caps resting on top edges of said combustion chamber walls.

2. The stove of claim 1 further including air induction means for inducting air into said combustion chamber and means for removing products of combustion from said combustion chamber.

3. The stove of claim 2 wherein said air induction means includes a draft tube attached at one end to said stove top and having another end located near said combustion chamber, and further including a draft tube control disc pivotally mounted on said stove top for controlling the amount of air flowing into said draft tube.

4. The stove of claim 1 wherein the stove is air-tight.

5. A downdraft stove comprising:

a base;

a stove front, a rear wall and a pair of side walls on said base and extending away therefrom, said rear and side walls each including a central portion, an end portion on each end of said central portion, and offset portions connecting said central and end portions together, said end portions being essentially coplanar with each other and in a plane which is in spaced parallelism with a plane containing said central portion;

a stove top wall on said walls and spaced from said base;

a pair of transluscent access doors in said stove front wall;

a firebrick combustion chamber located within the stove and including a bottom on said base, and combustion chamber walls located inwardly adjacent said stove front, rear and side walls and extending from said base for a portion of the distance between said base and said top wall, said combustion chamber front wall located adjacent said stove front wall extending from said base to immediately subjacent said access doors;

a pair of draft tubes each attached at one end thereof to said stove top wall and depending downwardly into said stove, each draft tube having another end thereof located to direct air downwardly onto the upper surface of fuel located in said combustion chamber, the fuel burning from the upper area thereof downwardly;

an anti-warping bar on said stove top wall, said bar extending from one side wall to the other side wall;

holder support means located adjacent the intersection of said combustion chamber walls for positioning said combustion chamber walls and for reinforcing said combustion chamber wall intersections; and top caps each having a depending lip extending from said front, rear and side walls over the top edges of said combustion chamber walls with a top cap on said front combustion chamber wall located adjacent said stove front wall being integral with said stove front wall.

6. The stove of claim 5 further including a baffle plate within the stove.

7. The stove of claim 5 wherein said top caps are attached to said stove walls.

8. The stove of claim 5 wherein said access doors include an inner frame, an outer frame and a viewing element sandwiched between said frames.

9. The stove of claim 8 wherein said viewing element includes heat resistant glass.

10. The stove of claim 5 further including an apron on said stove base.

11. The stove of claim 5 wherein said access doors include handles and a lock.

12. The stove of claim 5 further including means in said stove top wall for removing products of combustion from said combustion chamber.

* * * * *